US006029845A

United States Patent [19]

Mueller

[11] Patent Number: 6,029,845

[45] Date of Patent: Feb. 29, 2000

[54] FLOATING BEVERAGE HOLDER

[75] Inventor: Michael A. Mueller, Fort Lauderdale, Fla.

[73] Assignee: Midemue Group, Inc., Ft. Lauderdale, Fla.

[21] Appl. No.: 09/172,320

[22] Filed: Oct. 14, 1998

[51] Int. Cl.[7] ..... B65D 1/24

[52] U.S. Cl. ..... 220/560; 220/737

[58] Field of Search ..... 220/560, 737

[56] References Cited

U.S. PATENT DOCUMENTS

| | | |
|---|---|---|
| D. 240,888 | 8/1881 | Roussel . |
| 2,531,562 | 11/1950 | Eve . |
| 2,660,194 | 11/1953 | Hoffman . |
| 3,251,639 | 5/1966 | Silowash . |
| 3,848,766 | 11/1974 | Ganti et al. . |
| 4,571,194 | 2/1986 | Kiss . |
| 4,705,085 | 11/1987 | Brown . |
| 4,871,079 | 10/1989 | Doucette . |
| 5,088,948 | 2/1992 | Scheurer . |
| 5,165,583 | 11/1992 | Kouwenberg et al. . |
| 5,277,328 | 1/1994 | Tocco . |
| 5,369,796 | 11/1994 | Kung . |
| 5,727,709 | 3/1998 | Nobile . |

*Primary Examiner*—Joseph M. Moy
*Attorney, Agent, or Firm*—Brinkley, McNerney, Morgan, Solomon & Tatum, LLP

[57] ABSTRACT

A floating beverage holder for use in water sports. The beverage holder contains a plurality of cavities for holding cans or bottles, and has sufficient volume to provide the required buoyancy and which can support the beverage holder on water when the beverage holder contains combinations of cans and bottles. The design of the beverage holder makes the floating beverage holder virtually un-tipable. A housing is provided in the larger beverage holders for storage of food, ice, or bathing supplies.

21 Claims, 8 Drawing Sheets

```
REM pgm called smflo.
 RA=57.29578: REM conversion from radians to degrees Multiply rad by ra to g
degrees.
 OPEN "lpt2:" AS #2
PRINT #2," "
PRINT #2," "
PRINT #2," "
CT=1
 VD=28316.84:REM volume of 1 cubic foot ib cm^3
 WD=1359: REM equals wt of 1 cubic foot, (3 lbs)
DX = WD/VD:REM density of material
CLS
PI=3.14159265359#
0 PRINT #2," Page No. 0. figure  7, density = 3 lbs per CU ft."
0 FOR WX=12 TO 20
0 D1=WX
0 H1=4
0 P=1
0 DC= D1*2.54 :REM dia in CM
0 HC= H1*2.54:REM height in cm.
0  A1= ((DC/2)^2)*PI: REM area of disk surface.:rem area in cm^2
0 VOL= A1*HC:REM volume of total body in cubic cm.
0 'TC=TC+1: IF TC=4 THEN PRINT#2,CHR$(12):TC=1:PP=PP+1: PRINT #2," page No. ":
:"
0 WP= VOL*DX:  REM weight of material
0 TC=TC+1: IF TC=4 THEN :TC=1:PP=PP+1: PRINT #2," page No. ";PP;"
0 PRINT #2, " For a diameter of ";D1;" inches the count is ";TC;" "
0   PRINT #2," TOTAL WT  12 oz.cans   24 oz.bottles  Depth inches "
0   PRINT #2,"  (grams)    No. of         No. of      in water       inches"
0 PRINT #2, "_____________________________________________________________"

0 FOR CX=1 TO 2:REM no of cans
0 FOR BY=0 TO 2: REM no of 24 oz bottles
0 IF CX=0 THEN CA=.000001
0 IF BY=0 THEN BO=.000001
0 IF CX=0 AND BY=0 THEN PRINT" you have entered an impossible value.- start o
 hit any key to continue":INPUT K$:GOTO 30
0 W1= CX*368.55:REM one 12 oz can times no of cans.
0 W2=BY*737.1: REM one 24 oz bottle times no of bottles.
0  WT= (W1+W2):REM wt in grams
0 REM computation of depth
0  H = (W1+W2+WP)/A1 : REM corrected depth.
0 'PRINT" THE DEPTH IN CM=";H ;" "
0 I1= H /2.54
0 'PRINT"the depth  is ";I1;"inches"
0 REM  check 1
0 VC=DT*A1:REM volume of submerged portion
0 VB= A1*H
0 'H=VB/A1: PRINT H
0 E1=INT((I1)*100+1)/100
0   PRINT #2,"";WT;,;CX;,;BY;,;E1;:PRINT#2, CHR$(10)
0 NEXT BY
0 'NEXT CX: PRINT#2, CHR$(10): IF TC=3 THEN PRINT #2,CHR$(12):rem orig line
0 NEXT CX: IF TC=3 THEN PRINT #2,CHR$(12)
0 NEXT WX
0 ' PRINT #2, CHR$(10)
0 'PRINT #2, CHR$(12)
```

FIGURE 12

```
REM pgm called lgfLoat
OPEN "lpt2:" AS #2
PRINT #2," "
PRINT #2," "
PRINT #2," "
CLS
NP=1
VD=28316.84:REM volume of 1 cubic foot lb/cm^3
WD=1359:REM equals wt of 1 cubic foot (3 lbs)
DX=WD/VD:REM density of material
PI=3.14159265359#
D1=36
H1=4
DC= D1*2.54 :REM dia in CM
0 HC= H1*2.54:REM height in cm.
0  A1= ((DC/2)^2)*PI: REM area of disk surface.:rem area in cm^2
0 VOL= A1*HC:REM volume of total body in cubic cm.
1  WP=VOL*DX
2 PRINT #2." LARGE  3 FT. FLOTATION DEVICE"
3 PRINT#2.
5 PRINT#2, "Page No  ":NP::REM first page:?density =3 lbs/cu ft.
6 PRINT #2,
0   PRINT #2,"12 oz.cans   24 oz.bottles  depth inches"
0 FOR CX=1 TO 12 :REM no of cans
0 FOR BY=0 TO 12: REM no of 24 oz bottles
0 IF CX=0 THEN CA=.000001
0 IF BY=0 THEN BO=.000001
0 IF CX=0 AND BY=0 THEN PRINT" you have entered an impossible value,- start ov
 hit any key to continue":INPUT K$:GOTO 7
0 W1= CX*368.55:REM one 12 oz can times no of cans.
0 W2=BY*737.1: REM one 24 oz bottle times no of bottles.
0 REM computation of depth
0  H = (W1+W2+WP)/A1
0 I1= H /2.54
0 REM  check 1
0 VC=DT*A1:REM volume of submerged portion
0 VB= A1*H
0 E1=INT((I1)*100+1)/100
0 PRINT #2,:CX;,;BY;,:E1
0 LN=LN+1: REM printed lines
0 IF LN=45 THEN GOSUB 500
0 NEXT BY
0 NEXT CX
1 PRINT #2. "12 oz.cans   24 oz.bottles  depth inches"
2 NP=NP+1
5 IF LN=45 THEN GOSUB 500
0 PRINT #2, CHR$(12)
0 END
0 REM subroutine
0 PRINT #2, CHR$(12)
1 PRINT #2."Large flotation device, continued"
2 PRINT #2, " PAGE NUMBER  ";NS::PRINT #2,
0 PRINT #2, "12 oz.cans   24 oz.bottles  depth inches"
0 LN=1
5 NS=NS+1: REM PAGE NO.
0 RETURN
```

FIGURE 13

FLOATING BEVERAGE HOLDER

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

This invention generally relates to floating beverage holders for use by those who are engaged in water activities. People who are engaged in water activities in pools, Jacuzzis, oceans or lakes often have a desire to keep a beverage or foodstuffs in the water and nearby. Several schemes have been employed to satisfy this need. Prior art reveals inflatable tubes, Styrofoam boxes and the like for holding beverages and food in an aquatic environment. Flotation devices are well known and have been in use for many years. The present invention better serves the purpose for which it is intended, and constitutes a significant advance in the art. Modern materials, having a very low density, are used herein. The resulting floating beverage holder is virtually tip-proof for any combination of cans, bottles, ice or food placed thereon. The floating beverage holder is also an excellent insulator.

2. Description of Related Art

Background art includes U.S. Pat. No. 2,531,562. FLOATING SUPPORT FOR GROWING PLANTS, issued to Philip H. Eve on Nov. 28, 1950. This patent reveals a plurality of pots and devices for growing plants by floating them in a water environment, such as a pool. The floatation devices have a bore therethrough for the plants to pass through in order to provide a measure of stability and root watering capability.

U.S. Pat. No. 5,369,796, entitled FLOATING SOUND SYSTEM, issued to G. E. Kung on Nov. 29, 1994. This invention describes a circular tube which is used as a flotation element. A sealed compartment contains power sources and electronics to make up a radio and a companion sound system.

U.S. Pat. No. 5,277,328 entitled MULTIPLY COMPARTMENTED COOLER, issued to Tocco on Jan. 11, 1994. This invention describes an octagon shaped vessel which is employed as a combination cooler and carrier for drinks. No cooling is supplied. The entire body of the cooler is an insulator.

U.S. Pat. No. 5,727,709 entitled THERMALLY INSULATED FLOATING BEVERAGE CONTAINER HOLDING DEVICE, issued to Nobile on Mar. 17, 1998. This patent describes a weighted floatable container capable of holding a single can or beverage, or suitably sized drink container. The invention can be placed on a dry surface, or in the water, and is intended to remain stable.

U.S. Pat. No. 5,088,948 entitled BUOYANT BEVERAGE CONTAINER FOR SWIMMING POOL USE issued to Scheurer on Feb. 18, 1992. This patent describes a plastic bottle-like container which contains a weight in the lower section of the container body, making the container float with the top up, regardless of the beverages placed thereon.

U.S. Pat. No. 4,571,194 entitled COLLAPSIBLE AND FLOATABLE BEVERAGE HOLDER, issued to Kiss et al on Feb. 18, 1986. This patent describes an inflatable circular tube with a single beverage holder in the center of the ring.

U.S. Pat. No. 2,660,194 entitled EXPANDED CELLULAR PLASTIC FLOTATION BODY, issued to J. J. Hoffman on Nov. 24, 1953. This patent describes a cellulose box which will float on water, and which will not be shattered when subject to abuse, for example, being shot with a 0.50 caliber bullet. The composition of those early materials is described.

U.S. Pat. No. 3,848,766 entitled INSULATED CONTAINER PACK, issued to Gatt et al. on Nov. 19, 1974. This patent describes a holder having cavities for holding containers for beverages, wherein the cavity material is capable of insulating the beverage containers, enabling them to remain cool for several hours.

BRIEF SUMMARY OF THE INVENTION

Modern low density plastic closed-cell foam materials find application in thermo-insulators and in flotation devices. These materials consist of polyvinyl chloride, polyprolene, polyethylene, poly methyl chloride, styrene, cellulose, and expanded polystyrene or expanded polyethylene. In addition to low density, the polystyrene and polyethylene derived materials are impervious to water-logging, and can continue to float indefinitely. The preferred material for the present embodiment is an extruded polyethylene, which may be molded in a variety of colors.

This material is so very buoyant that a cylindrical form 2.75 inches in diameter and five feet in length can support a grown adult in the water. An example of a product made of this material, and sold as a pool flotation device, is sold under the trademark "Funnoodle", manufactured by Kidpower, Inc. of Tennessee and California.

One material of which the invention may be made has a density of 3 pounds per cubic foot, or 0.047992 grams per cubic centimeter. This material is also available in other densities such as 4 pounds per cubic foot. In general, the material having a density of 4 lbs. per cubic foot will cause the floating beverage holder to sink further in the water by approximately 30 percent over the material having a density of 3 pounds per cubic foot. The basic floating beverage holder of the instant invention can be molded or extruded. If an upper housing is desired, it may be included in the mold, or attached by melting the upper surface of the base and the bottom of the upper housing and pressing the parts together while the surfaces are melted. The resulting joint is a weld, and is permanent.

This disclosure illustrates several examples of a floating beverage holder in accordance with my invention. These different configurations are generally similar, and differ in size and capacity. A plurality of receptacles are molded into a circular or polygon shaped body. It will be apparent to those skilled in the art that any shape can be used, providing the material, volume and surface area are sufficient to provide the required buoyancy. The body of the floating beverage holder may be referred to as a "base". The floating beverage holders are, for example but not by way of limitation, 4 inches in height, and define a plurality of bores or cavities for holding cans or bottles. These bores or cavities are defined by bottom walls. The bores for holding cans are approximately three inches in diameter, and the bores for holding bottles are approximately three and a half inches in diameter, each bore having a depth of approximately three and a half inches, leaving a 0.5 inch floor or bottom wall in each bore or cavity. In the bottom of each bore, a one half inch diameter opening may be provided to allow water to drain. Water coming into the opening will not affect the buoyancy of the device.

The three and a half inch cavities may be sized to receive an insulating sleeve or cooler cup, which slips over the standard beverage receptacle for improved insulation.

Although a circular floating drink holder is illustrated for clarity, the shape may be oval, star shaped, rectangular or any shape convenient to the manufacturer. I have found that providing a base having a presented, i.e.: bottom plan, surface area on the order of 113 square inches (729.66 square centimeters) and a height of approximately four inches (10.16 centimeters), has worked particularly well from the point of view of both buoyancy and stability to support two full 12 ounce cans of beverage and two full 24 ounce bottles of beverage, for a combined weight of 2211.3 grams (approximately). Thus, a ratio of presented area to height, when expressed in inches, of approximately 28.25 is suitable.

The height of the device relating to its area is at the core of my invention. As the number of items on one side of the base increase, there is a tendency for the base to sink deeper into the water on that side. As the base sinks lower into the water, more water is displaced, and the buoyant force increases. This feature makes the floating beverage holder virtually un-tipable with the proper area to height proportionality. Moreover, the taller the body of my device, the deeper the beverage receptacle bores may be, which in turn provides a greater capacity for the device to maintain the beverage receptacles in an upright orientation.

Circular bases have been illustrated in this application solely because the mathematics for a circular floatation base is generally simple, and the circular configurations exemplify the spirit of the invention. A polygon is also shown as a more decorative version of the floating beverage holder. A three foot diameter polygon is illustrative of the present invention, but the size can be expanded to accommodate additional beverage containers as may be required. The 36 inch diameter floating beverage holder can accommodate as many as 24 containers of drink. The large surface area of 1017.8 square inches (6567 $CM^2$) can support 37 pounds per inch of depth in water. The total weight of filled cans and beverage bottles is approximately 29.13 lbs.

A principal object of the present invention is to provide a floating beverage holder which can simultaneously support a plurality of cans and/or a plurality bottles of beverage, or other containers. The base portion is designed such that, when floating and having cans or bottles or other matter thereupon, the float is stable, and virtually impossible to tip over by ordinary wave action which accompanies recreating in water. This stability is accomplished by having a holder whose height is sufficiently tall so that tipping causes increased buoyancy, preventing the floating beverage holder of the instant invention from tipping over.

Another object of the present invention is to provide a floating beverage holder which is both an insulator and a floatation device.

It is another object of this invention to provide a means for securing the floating beverage holder to a raft or other object to prevent the beverage holder from floating away.

It is yet another object of this invention to provide an embodiment of this invention which incorporates a means for storing items, e.g. foodstuffs, ice, towels or bathing supplies, in an insulated container which is integral to the body of the floatation portion of the beverage holder of the present invention.

These and other objects, advantages, features and benefits of the present invention will become apparent from the following drawings and specification.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 12 is a printout of the BASIC language program which performs the computations which result in the values depicted in FIG. 11.

FIG. 13 is a printout of the BASIC language program which performs computations resulting in the values depicted in FIG. 12.

DETAILED DESCRIPTION OF THE INVENTION

For the sake of clarity, where practical, like objects in each view have been given like reference numbers.

Figure 1:
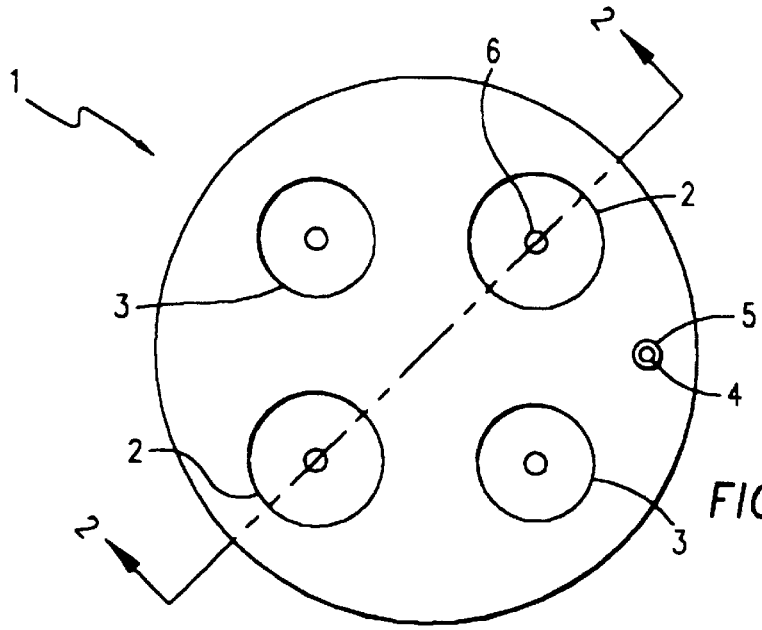
FIGS. 1–3 illustrate the floating beverage holder of the instant invention.

FIG. 1 illustrates the small beverage holder of the present invention. Although a disk-like base 1 is illustrated, the shape may be oval, star shaped, or any shape which satisfies the desire of the manufacturer. The beverage holder in this illustration has a nominal diameter of 12 inches, and further has a plurality of cavities or bores 2 and 3, which do not completely penetrate the base 1 and are delineated at their bottoms by bottom walls B. The depth of these cavities 2 and 3 is approximately 3.5 inches for a height H of the beverage holder base of 4 inches and a diameter D of 12 inches. Cavity 3 has a diameter $d_2$ of 3 inches. Cavity 2 has a diameter $d_1$ of 3.5 inches. It is important to note that the cavities 3 and 4 may be of any size and shape and that all cavities 3, 4 may be of equal size and shape. Each cavity has a bottom portion therein which prevents the beverage container from falling through the beverage holder. Each bottom wall B has a bore or opening therethrough 6 for draining fluid which may accumulate in the cavity. Furthermore, when the base is deeper in the water than ½ inch, water which may be in a cavity helps to stabilize the base. The 3.5 inch cavities may be used to hold a can which has an insulating sleeve around the can body. Any combination of bore diameters may be employed. For example, all four bores may be of equal diameter (as mentioned above), or they may be staggered as shown.

Figure 4:
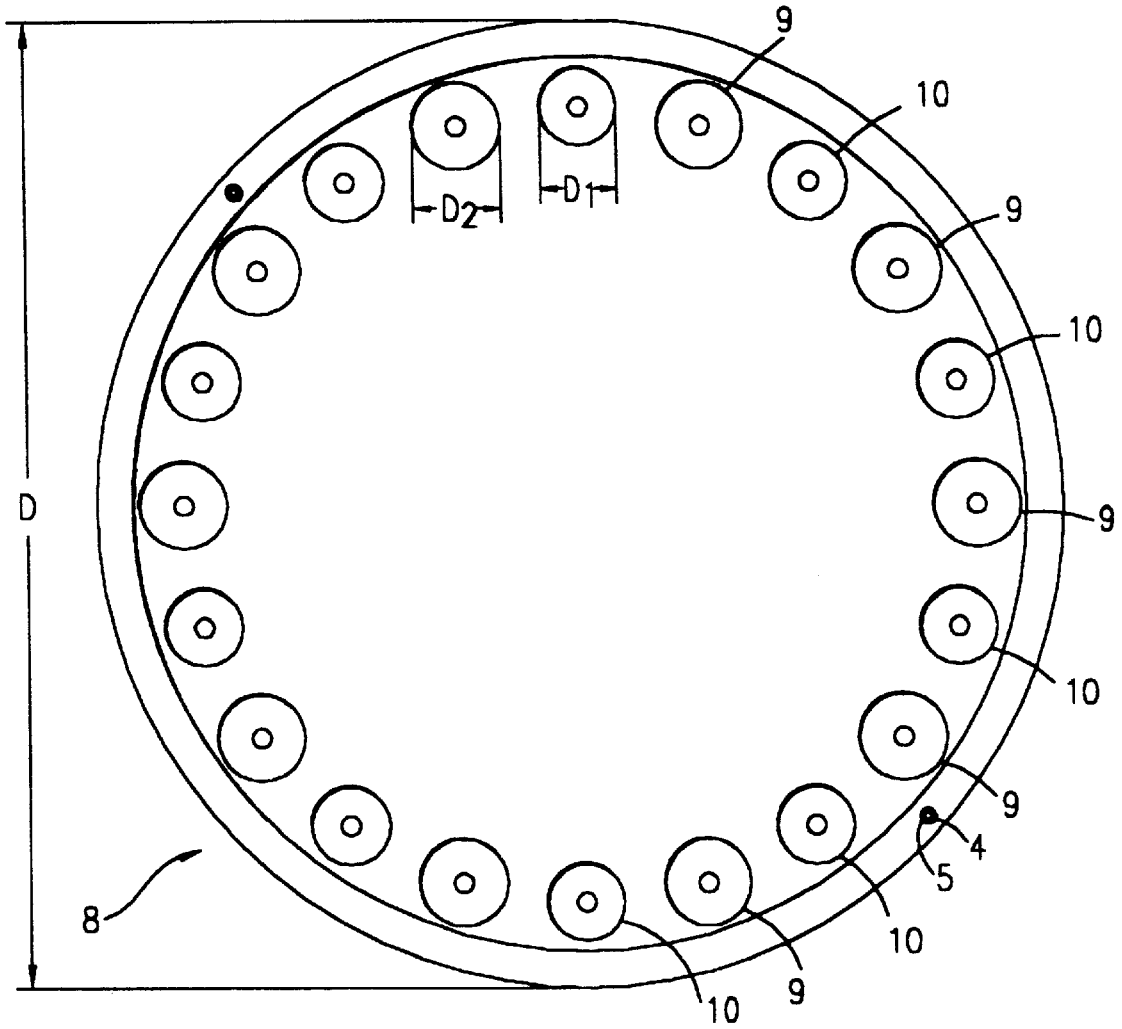
FIG. 4 illustrates an alternative, larger diameter, embodiment of the instant invention.

A larger beverage holder 8 shown in FIG. 4, three feet in diameter, is designed to support a larger quantity of beverage receptacles and the like. In this configuration, the beverage holder 8 can accommodate a dozen 12 ounce beverage cans in cavities 10 and twelve 24 ounce beverage bottles in cavities 9. The can and bottle locations are staggered to improve the stability of the beverage holder 8. A bore through the holder body 4, coupled with a metal or plastic grommet and sleeve 5, provides a place for a tether (not shown) to be attached to the beverage holder for securing the beverage holder to a raft or other object to prevent the beverage holder from floating away.

Figure 5:
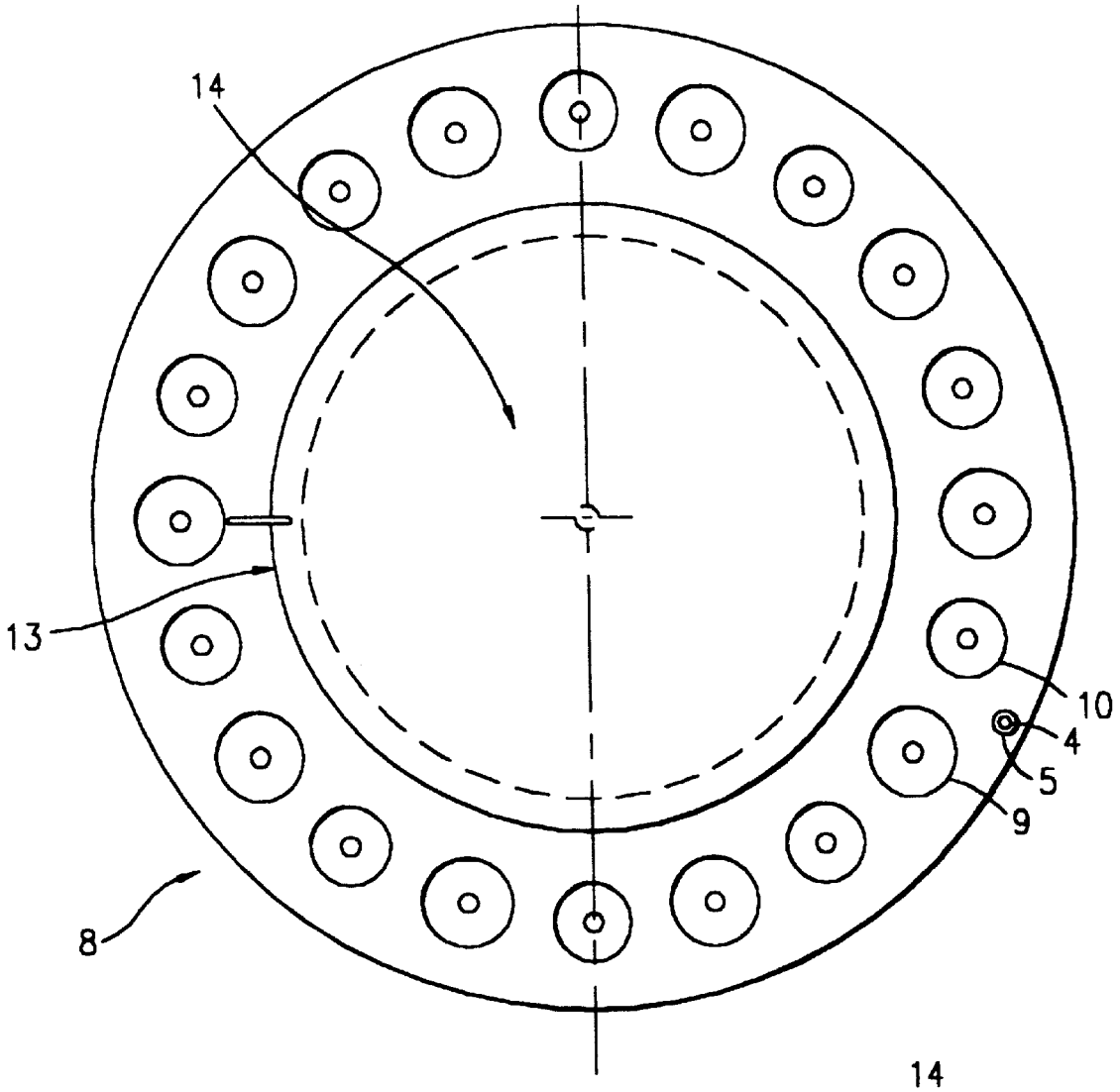
FIGS. 5–6 show a modified version of the embodiment of FIG. 4 which incorporates a central container for food, ice, etc.
Figure 6:
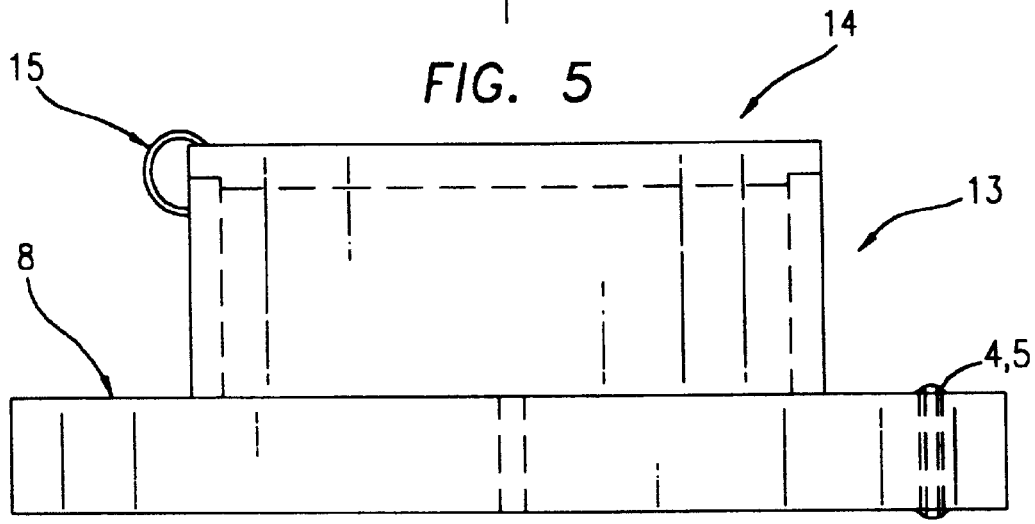

FIGS. 5–6 illustrate a further modification of the beverage holder of this invention. FIGS. 5–6 show a beverage holder with a centrally located storage volume or compartment 14 built integrally within the body of the floating beverage holder. The compartment 14 may be fabricated separately and thermally welded to the top surface of the floating beverage holder 8, or may be molded as one piece with the beverage holder.

If the beverage holder 8 is filled with twelve 12 ounce cans and twelve 24 ounce bottles, and if the holder 8 settles one inch into the water, the central storage compartment 14 can hold up to eight pounds of ice, food, bathing supplies, or whatever is desired. The storage compartment 14 depicted in FIGS. 5–6 can be round, square, oval, or any shape that is convenient. The height of the storage area can be as much as 12 inches. A cover fits onto the top of the storage compartment, and is secured with a short tether 15 to prevent accidental loss of the cover.

Figure 2:
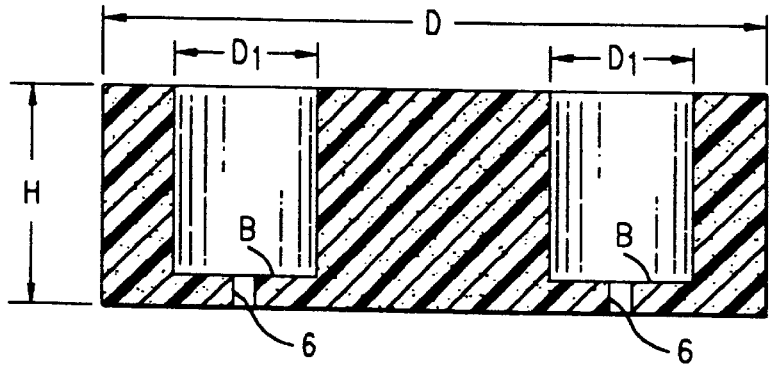
Figure 3:
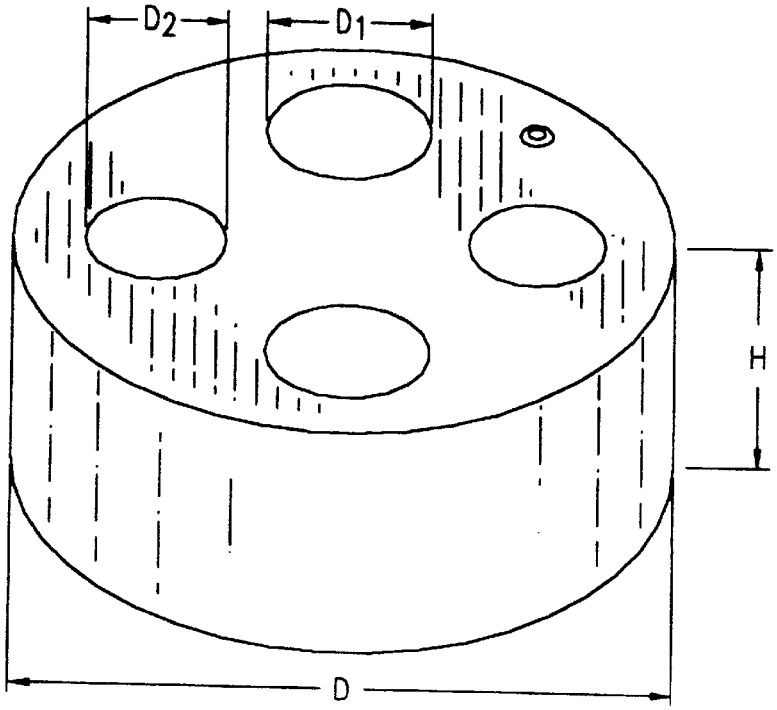

For the small flotation device of FIGS. 1–3, there are two 12 ounce cans of soda and 2 large bottles (24) ounce of soda used n the computation. Soda also comes in a 21 ounce size, but the worst case (largest weight) is for the 24 ounce size. The computations in the tables set forth below compute the depth for one to four soda containers, for floats whose diameters range from 12 inches to 20 inches.

For the large flotation device, which has a diameter of 3 feet (36 inches), if the beverage containers are alternated small, large, small, large, etc., the stability will be greatest.

The following rules apply. In water, by Archimedes principle, the buoyant force in grams is equal to the weight of the volume displaced, expressed in cubic centimeters.

Variables.

Diameter in inches×2.54=diameter in CM

Diam in (CM/2)=Radius in CM

Area of section in the water=Pi×(Rad×Rad)

Volume of float in water=area of section in water×the depth in water.

Depth will be computed from combined weight of the beverage containers and the float.

The correction for the mass of the flotation material is calculated as follows. The present material has a weight of 3 pounds per cubic foot. The density 8 is also factored into the overall "weight" of the loading on the float as follows (once again, the values are converted to cubic centimeters):

1 cubic foot=28316.84 cubic centimeters

One cubic foot of the material weighs 3 lbs. There are 453 grams in one pound. Therefore, the gram weight of one cubic foot of the float material is 1359.

The density of the material equals 1359/28316.84=0.047992 grams per cubic centimeter (CC).

Once the depth is solved, the weight in grams of the submerged part is added to the computations, and the depth of the body in water is recomputed, the final result being deeper by the effect of the mass of the material.

The following constants and equations apply:

For the smaller float, diameter is varied from 12 inches to 20 inches. In 1 inch steps, and the flotation as a function of the quantity cans or bottles is depicted.

For the larger float, diameter is held at 36 inches. The depth is presented for all combinations of 12 ounce cans and 24 ounce bottles that can be supported on the floatation platform. Totaling 24 items alternative selected.

The following applies:

Pi=3.14159265359

Diam (CM)=diam (in×2.54

W1=Wt of cans−No of cans×368.55 grams

W2 =Wt of bottles=No of 24 oz. bottles×737.1 grams (a 21 oz. bottle weighs 644.96 grams)

A1=Area=Pi X (R×R) or pi R squared.

Depth in CM=depth in inches×2.54

Vol of flotation media=area×depth off flotation media to support its own weight. WX−vol×density=vol in cubic centimeters×0.049 grams per CC.

Accordingly, the depth is the summation of all effective weight divided by the cross sectional area of the floatation platform. Divide that number by 2.54 to obtain the depth in water, expressed in inches. The program does all of these computations, iterates them, and sets forth the results in the tables.

Figure 7:
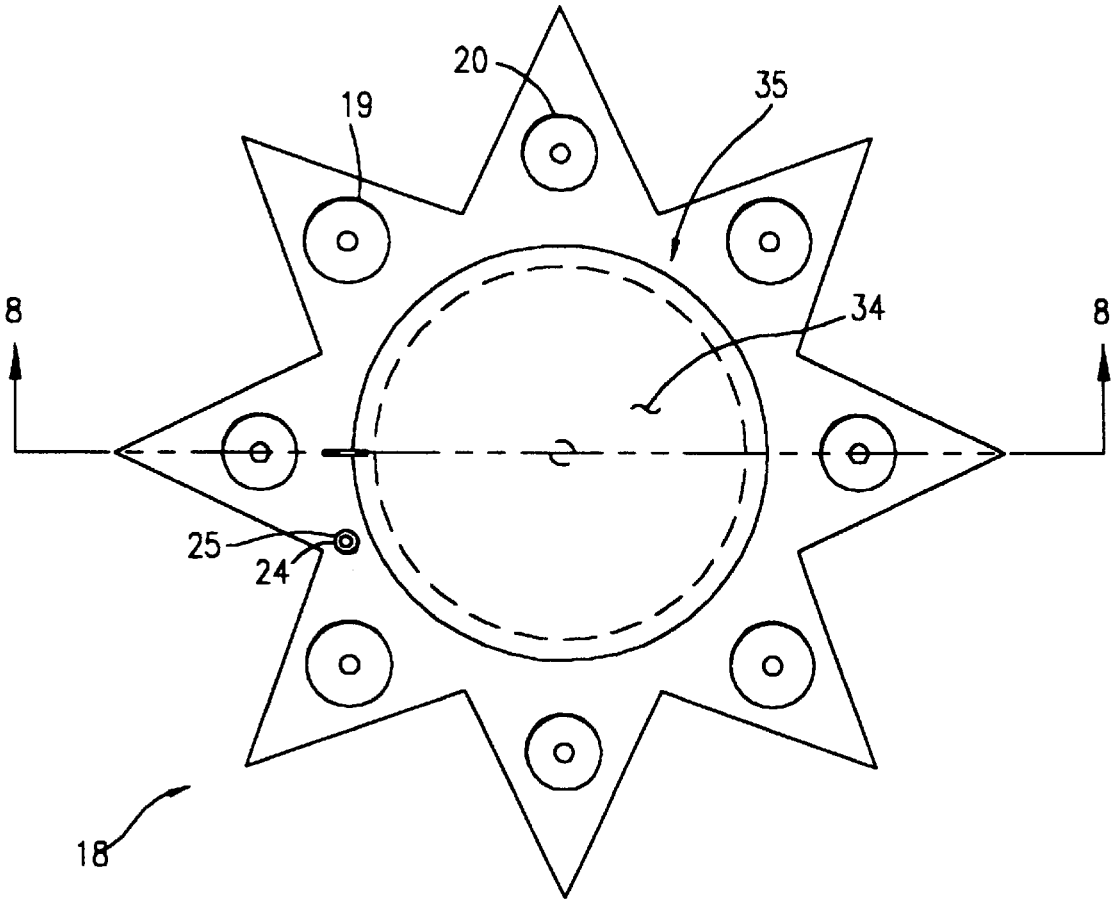
FIGS. 7–8 illustrate a polygonally shaped embodiment of the instant invention.
Figure 8:
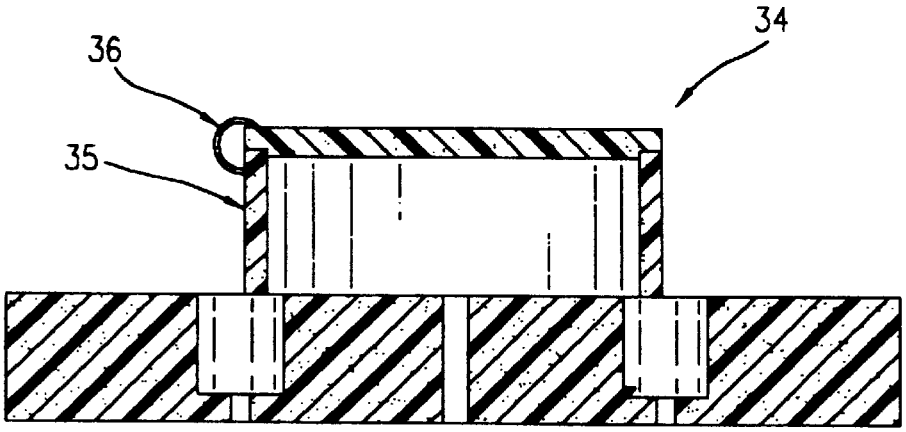

Although the beverage holders in the previous illustrations are round, the invention can be embodied in other, more decorative, shapes. FIGS. 7–8 show a generally star shaped beverage holder 18. The container holders 19–20 are mounted around an eight sided polygon, each side fitted with a triangular shaped member, integral to the body, forming an eight sided "star". This design holds eight beverage cans or bottles. The diameters of the cavities 19 and 20 are staggered for balance and improved stability. The holder 18 can be molded in a variety of colors and provided with any desired surface treatment to enhance the decorative effect. A central storage compartment 35 may be employed for storage of ice, food, etc. A cover 34 may also be used, attached to the wall of compartment 35 with tether 36.

Figure 9:
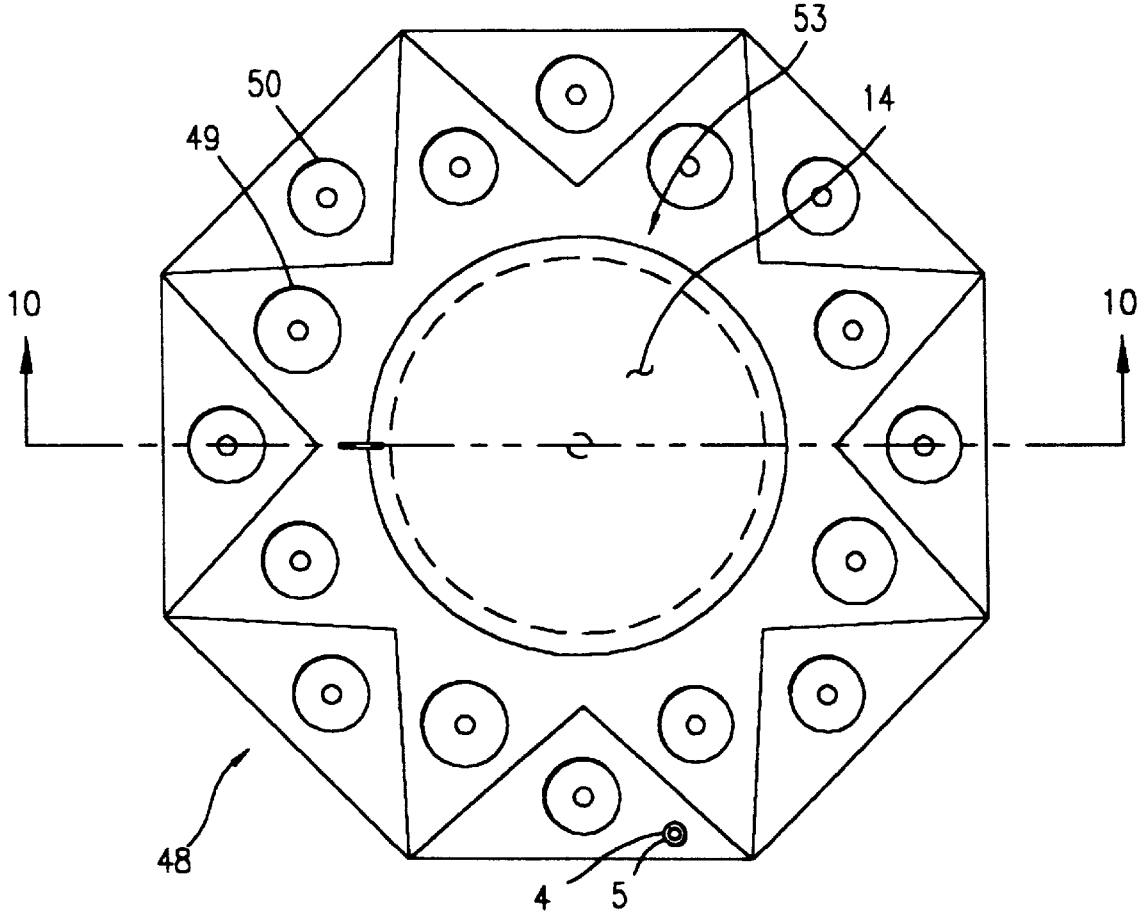
FIGS. 9–11 illustrate a further alternate embodiment of the invention.
Figure 10:
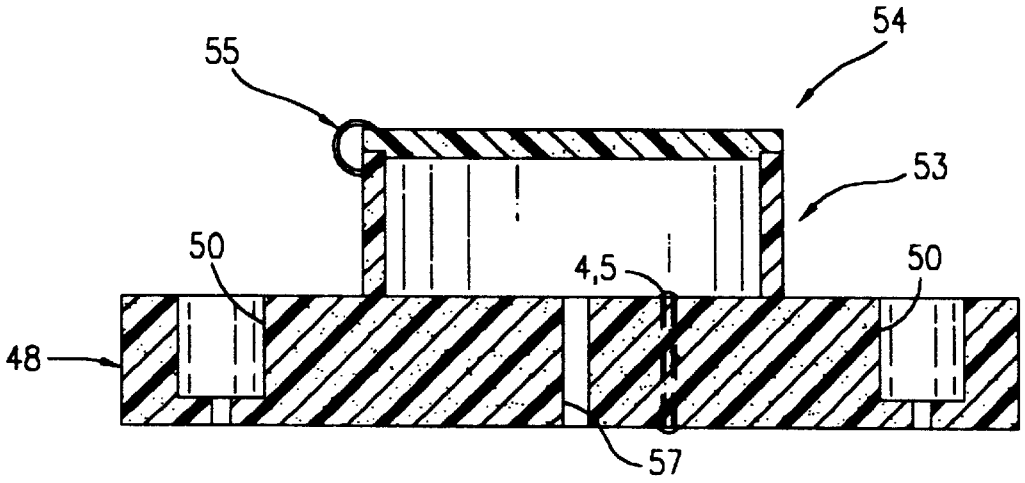
Figure 11:
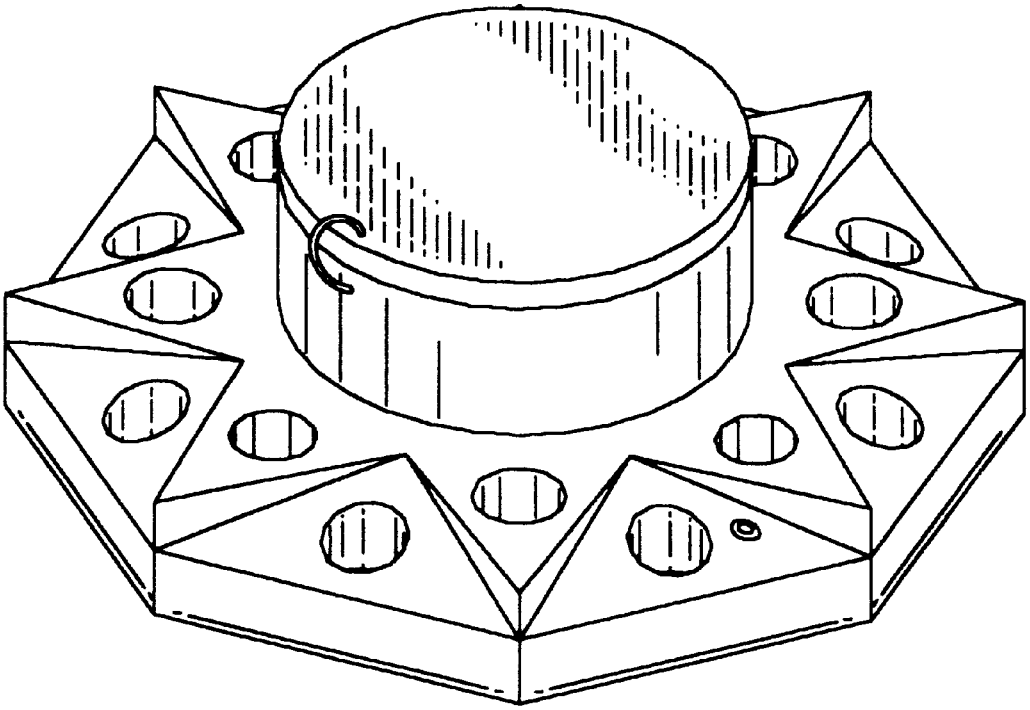

A further embodiment of the present invention can be seen in FIGS. 9–11. In this view, the floating beverage holder has been reconfigured as an eight sided polygon having a base section 48. Beverage container receptacles 49 and 50 are employed and are preferably of different diameters to accommodate different sized containers. As for base section 48, it has been found that having a presented area of 729 $cm^2$ for every two 12 ounce cans and every two 24 ounce bottles works excellently, although smaller presented areas can be selected so long as the height of the device is sufficient to maintain the device afloat and stable. The radii of the larger bores 20 are smaller than the radii of the smaller bores 19 to accommodate insulating sleeves placed over cans or bottles or to accommodate larger diameter cans or bottles. A storage compartment comparable to compartment 35 of FIGS. 5–8 may be provided. A drain passage 57 should be used to allow liquid within compartment 53 to drain as needed.

The following tables set forth the results of analysis using Archimedes' principle, wherein a body is buoyed up by a force equal to the weight of water that it displaces. The computations arrived at the depth to which the beverage holder will sink in fresh water, and include the effect on sinking of the density and weight of the beverage holder material. The equations used also include the effects of the mass of the material. For expanded polyethylene, which is the preferred material, the density is approximately 3 pounds per cubic foot. The computations were carried out by varying the diameter of the holder of FIGS. 1–3 between 12–20 inches and by placing one to four full beverage containers therein. The beverage holder used in these calculations has a density of 3 pounds per cubic foot. The following tables illustrate various combinations of cans and bottles of beverage that may be used, and the depth to which the floating beverage holder will sink.

TABLE 1

DIAMETER = 12 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .34 |
| 1359.975 | 1 | 1 | .74 |
| 2097.075 | 1 | 2 | 1.14 |
| 1245.75 | 2 | 0 | .68 |
| 1982.85 | 2 | 1 | 1.07 |
| 2719.95 | 2 | 2 | 1.47 |

TABLE 2

DIAMETER = 13 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .29 |
| 1359.975 | 1 | 1 | .63 |
| 2097.075 | 1 | 2 | .97 |
| 1245.75 | 2 | 0 | .58 |
| 1982.85 | 2 | 1 | .92 |
| 2719.95 | 2 | 2 | 1.26 |

TABLE 3

DIAMETER = 14 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .25 |
| 1359.975 | 1 | 1 | .54 |
| 2097.075 | 1 | 2 | .84 |
| 1245.75 | 2 | 0 | .5 |
| 1982.85 | 2 | 1 | .79 |
| 2719.95 | 2 | 2 | 1.08 |

TABLE 4

DIAMETER = 15 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .22 |
| 1359.975 | 1 | 1 | .47 |
| 2097.075 | 1 | 2 | .73 |
| 1245.75 | 2 | 0 | .44 |
| 1982.85 | 2 | 1 | .69 |
| 2719.95 | 2 | 2 | .94 |

TABLE 5

DIAMETER = 16 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .19 |
| 1359.975 | 1 | 1 | .42 |
| 2097.075 | 1 | 2 | .64 |
| 1245.75 | 2 | 0 | .38 |
| 1982.85 | 2 | 1 | .61 |
| 2719.95 | 2 | 2 | .83 |

TABLE 6

DIAMETER = 17 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .17 |
| 1359.975 | 1 | 1 | .37 |
| 2097.075 | 1 | 2 | .57 |
| 1245.75 | 2 | 0 | .34 |
| 1982.85 | 2 | 1 | .54 |
| 2719.95 | 2 | 2 | .74 |

TABLE 7

DIAMETER = 18 INCHES

| TOTAL WT OF BEVERAGE HOLDER (grams) | 12 OZ. BEVERAGE RECEPTACLES (CANS) | 24. OZ BEVERAGE RECEPTACLES (BOTTLES) | DEPTH DEVICE IS SUBMERGED IN WATER (INCHES) |
|---|---|---|---|
| 622.875 | 1 | 0 | .15 |
| 1359.975 | 1 | 1 | .33 |
| 2097.075 | 1 | 2 | .51 |
| 1245.75 | 2 | 0 | .3 |
| 1982.85 | 2 | 1 | .48 |
| 2719.95 | 2 | 2 | .66 |

TABLE 8

DIAMETER = 19 INCHES

| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
|---|---|---|---|
| 622.875 | 1 | 0 | .14 |
| 1359.975 | 1 | 1 | .3 |
| 2097.075 | 1 | 2 | .46 |
| 1245.75 | 2 | 0 | .27 |
| 1982.85 | 2 | 1 | .43 |
| 2719.95 | 2 | 2 | .59 |

TABLE 9

| DIAMETER = 20 INCHES | | | |
|---|---|---|---|
| TOTAL WT OF BEVERAGE HOLDER (grams) | 12 OZ. BEVERAGE RECEPTACLES (CANS) | 24 OZ. BEVERAGE RECEPTACLES (BOTTLES) | DEPTH DEVICE IS SUBMERGED IN WATER (INCHES) |
| 622.875 | 1 | 0 | .13 |
| 1359.975 | 1 | 1 | .27 |
| 2097.075 | 1 | 2 | .41 |
| 1245.75 | 2 | 0 | .25 |
| 1982.85 | 2 | 1 | .39 |
| 2719.95 | 2 | 2 | .53 |

To illustrate the buoyancy of the present embodiment, pressing the beverage holder of FIG. 5 into the water to a depth of 1 inch, the beverage holder will be buoyed up by a force of approximately 37 pounds. Alternatively, a weight of 37 pounds will only cause the beverage holder to sink into the water by approximately 1 inch.

The following table shows the depth to which a beverage holder 3 feet in diameter having 24 cavities for holding 12 ounce cans and/or 24 ounce bottles will sink in fresh water using every possible combination of bottles and cans therein. As can be seen from the results, when using twelve 12 ounce cans of beverage and twelve 24 ounce bottles in the holder, the device will only sink to approximately 1.18 inches in depth. For a device having a height of 4 inches, there is plenty of buoyancy and stabilizing capacity remaining to cause the device to remain upright when encountering typical wave action which accompanies recreational swimming.

| LARGE 3 FT. FLOTATION DEVICE 12 OZ. BOTTLES OF BEER AND 24 OZ. BOTTLES OF SODA | | |
|---|---|---|
| 12 OZ. BOTTLES | 24 OZ. BOTTLES | DEPTH INCHES |
| 1 | 0 | .23 |
| 1 | 1 | .28 |
| 1 | 2 | .32 |
| 1 | 3 | .37 |
| 1 | 4 | .41 |
| 1 | 5 | .46 |
| 1 | 6 | .5 |
| 1 | 7 | .54 |
| 1 | 8 | .59 |
| 1 | 9 | .63 |
| 1 | 10 | .68 |
| 1 | 11 | .72 |
| 1 | 12 | .76 |
| 2 | 0 | .27 |
| 2 | 1 | .32 |
| 2 | 2 | .36 |
| 2 | 3 | .4 |
| 2 | 4 | .45 |
| 2 | 5 | .49 |
| 2 | 6 | .54 |
| 2 | 7 | .58 |
| 2 | 8 | .63 |
| 2 | 9 | .67 |
| 2 | 10 | .71 |
| 2 | 11 | .76 |
| 2 | 12 | .8 |
| 3 | 0 | .31 |
| 3 | 1 | .35 |
| 3 | 2 | .4 |
| 3 | 3 | .44 |
| 3 | 4 | .49 |
| 3 | 5 | .53 |

-continued

| LARGE 3 FT. FLOTATION DEVICE 12 OZ. BOTTLES OF BEER AND 24 OZ. BOTTLES OF SODA | | |
|---|---|---|
| 12 OZ. BOTTLES | 24 OZ. BOTTLES | DEPTH INCHES |
| 3 | 6 | .57 |
| 3 | 7 | .62 |
| 3 | 8 | .66 |
| 3 | 9 | .71 |
| 3 | 10 | .75 |
| 3 | 11 | .8 |
| 3 | 12 | .84 |
| 4 | 0 | .35 |
| 4 | 1 | .39 |
| 4 | 2 | .43 |
| 4 | 3 | .48 |
| 4 | 4 | .52 |
| 4 | 5 | .57 |
| 4 | 6 | .61 |
| 4 | 7 | .66 |
| 4 | 8 | .7 |
| 4 | 9 | .74 |
| 4 | 10 | .79 |
| 4 | 11 | .83 |
| 4 | 12 | .88 |
| 5 | 0 | .38 |
| 5 | 1 | .43 |
| 5 | 2 | .47 |
| 5 | 3 | .52 |
| 5 | 4 | .56 |
| 5 | 5 | .6 |
| 5 | 6 | .65 |
| 5 | 7 | .69 |
| 5 | 8 | .74 |
| 5 | 9 | .78 |
| 5 | 10 | .83 |
| 5 | 11 | .87 |
| 5 | 12 | .91 |
| 6 | 0 | .42 |
| 6 | 1 | .47 |
| 6 | 2 | .51 |
| 6 | 3 | .55 |
| 6 | 4 | .6 |
| 6 | 5 | .64 |
| 6 | 6 | .69 |
| 6 | 7 | .73 |
| 6 | 8 | .77 |
| 6 | 9 | .82 |
| 6 | 10 | .86 |
| 6 | 11 | .91 |
| 6 | 12 | .95 |
| 7 | 0 | .46 |
| 7 | 1 | .5 |
| 7 | 2 | .55 |
| 7 | 3 | .59 |
| 7 | 4 | .64 |
| 7 | 5 | .68 |
| 7 | 6 | .72 |
| 7 | 7 | .77 |
| 7 | 8 | .81 |
| 7 | 9 | .86 |
| 7 | 10 | .9 |
| 7 | 11 | .94 |
| 7 | 12 | .99 |
| 8 | 0 | .5 |
| 8 | 1 | .54 |
| 8 | 2 | .58 |
| 8 | 3 | .63 |
| 8 | 4 | .67 |
| 8 | 5 | .72 |
| 8 | 6 | .76 |
| 8 | 7 | .81 |
| 8 | 8 | .85 |
| 8 | 9 | .89 |
| 8 | 10 | .94 |
| 8 | 11 | .98 |
| 8 | 12 | 1.03 |
| 9 | 0 | .53 |
| 9 | 1 | .58 |

-continued

| LARGE 3 FT. FLOTATION DEVICE 12 OZ. BOTTLES OF BEER AND 24 OZ. BOTTLES OF SODA | | |
|---|---|---|
| 12 OZ. BOTTLES | 24 OZ. BOTTLES | DEPTH INCHES |
| 9 | 2 | .62 |
| 9 | 3 | .67 |
| 9 | 4 | .71 |
| 9 | 5 | .75 |
| 9 | 6 | .8 |
| 9 | 7 | .84 |
| 9 | 8 | .89 |
| 9 | 9 | .93 |
| 9 | 10 | .97 |
| 9 | 11 | 1.02 |
| 9 | 12 | 1.06 |
| 10 | 0 | .57 |
| 10 | 1 | .61 |
| 10 | 2 | .66 |
| 10 | 3 | .7 |
| 10 | 4 | .75 |
| 10 | 5 | .79 |
| 10 | 6 | .84 |
| 10 | 7 | .88 |
| 10 | 8 | .92 |
| 10 | 9 | .97 |
| 10 | 10 | 1.01 |
| 10 | 11 | 1.06 |
| 10 | 12 | 1.1 |
| 11 | 0 | .61 |
| 11 | 1 | .65 |
| 11 | 2 | .7 |
| 11 | 3 | .74 |
| 11 | 4 | .78 |
| 11 | 5 | .83 |
| 11 | 6 | .87 |
| 11 | 7 | .92 |
| 11 | 8 | .96 |
| 11 | 9 | 1.01 |
| 11 | 10 | 1.05 |
| 11 | 11 | 1.09 |
| 11 | 12 | 1.14 |
| 12 | 0 | .65 |
| 12 | 1 | .69 |
| 12 | 2 | .73 |
| 12 | 3 | .78 |
| 12 | 4 | .82 |
| 12 | 5 | .87 |
| 12 | 6 | .91 |
| 12 | 7 | .95 |
| 12 | 8 | 1 |
| 12 | 9 | 1.04 |
| 12 | 10 | 1.09 |
| 12 | 11 | 1.13 |
| 12 | 12 | 1.18 |

Although this invention has been shown and described with respect to detailed embodiments thereof, it will be appreciated and understood by those skilled in the art that various changes in form and detail thereof may be made without departing from the spirit and scope of the claimed invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A floating beverage holder for use in water recreation, said holder comprising a base section defining a plurality of cavities for holding cans or bottles, said beverage holder having sufficient buoyancy to support said holder on said water when said holder contains a full can or bottle of beverage in each cavity, and said base section characterized as having a ratio of downwardly facing surface area to height of between 23 to 33 inches.

2. The floating beverage holder of claim 1, wherein the material of said beverage holder is selected from the group consisting of polyvinyl chloride, polypropylene, polyethylene, poly methyl chloride, styrene, cellulose, wood, and extruded polyethylene, wherein extruded Polyethylene is the preferred material.

3. The floating beverage holder of claim 1, whereby the body of the floating beverage holder is capable of providing an insulating means for keeping said beverage cool for a period of time.

4. The floating beverage holder of claim 1,further including a housing for storage of foodstuffs, ice, towels, or bathing supplies.

5. The floating beverage holder of claim 4 whereby said base and said housing are integrally molded as one unit.

6. The floating beverage holder of claim 4 whereby said base and said housing are manufactured separately and are bonded together by thermal means.

7. The floating beverage holder of claim 4, further including a closable cover adapted to be removably placed upon the housing.

8. The floating beverage holder of claim 1, wherein the base is extruded polyethylene having a density of 3 pounds per cubic foot.

9. The floating beverage holder of claim 1, wherein the base is extruded polyethylene having a density of 4 pounds per cubic foot.

10. The floating beverage holder of claim 1, wherein the base is circular in plan.

11. The floating beverage holder of claim 1, wherein the base is polygonal in plan.

12. The holder of claim 1, wherein the ratio of presented area to height is between 25 and 35.

13. The holder of claim 1, wherein the ratio of presented area to height is between 27 and 30.

14. The holder of claim 1, wherein the ratio of presented area to height is 28.25.

15. A floating beverage holder for use in water recreation, comprising a buoyant body member which defines a plurality of beverage container receptacles for placement of beverage containers therein, said body member defining a downwardly projecting surface area and a height, said body member being characterized as having a ratio of downwardly projecting surface area to height of between 18.25 and 38.25.

16. The holder of claim 16, wherein said ratio is between 23.25 and 33.25.

17. The holder of claim 17, wherein said ratio is 28.25.

18. The holder of claim 16, wherein the body member consists of a material selected from the group consisting of polyvinyl chloride, polyprolene, polyethylene, poly methyl chloride, styrene, cellulose, wood and extruded polyethylene.

19. The holder of claim 19, wherein the material is extruded polyethylene having a density of 3 pounds per cubic foot.

20. The holder of claim 19, wherein the material is extruded polyethylene having a density of 4 pounds per cubic foot.

21. The holder of claim 16, wherein the downwardly projecting surface area is a polygon.

* * * * *